US006378345B1

(12) United States Patent
Lin

(10) Patent No.: US 6,378,345 B1
(45) Date of Patent: Apr. 30, 2002

(54) SOFT KEY

(76) Inventor: Weng-Teh Lin, 210 Broadway, Nashville, TN (US) 37201

( * ) Notice: Subject to any disclaimer, the term of this patent is extended or adjusted under 35 U.S.C. 154(b) by 0 days.

(21) Appl. No.: 09/598,299

(22) Filed: Jun. 21, 2000

(51) Int. Cl.[7] ..... E05B 19/06
(52) U.S. Cl. ..... 70/409; 70/395
(58) Field of Search ..... 70/409, 410, 395, 70/396, 397, 399, 401, 407

(56) References Cited

U.S. PATENT DOCUMENTS

| | | | | | |
|---|---|---|---|---|---|
| 1,994,095 | A | * | 3/1935 | Caldwell | 70/409 |
| 4,111,019 | A | * | 9/1978 | Rabinow | 70/358 |
| 4,977,767 | A | * | 12/1990 | Prunbauer | 70/406 |
| 5,076,081 | A | * | 12/1991 | Boris, Jr. | 70/398 |
| 5,086,632 | A | * | 2/1992 | Hsu | 70/375 |
| 5,526,662 | A | * | 6/1996 | Diekhoff et al. | 70/278.2 |
| 6,401,629 | | * | 3/2000 | Huges | 70/394 |
| 6,105,404 | A | * | 8/2000 | Field et al. | 70/365 |

FOREIGN PATENT DOCUMENTS

| | | |
|---|---|---|
| TW | 162749 | 7/1991 |

* cited by examiner

*Primary Examiner*—William A. Cuchlinski, Jr.
*Assistant Examiner*—Olga Hernandez
(74) *Attorney, Agent, or Firm*—Bacon & Thomas, PLLC

(57) ABSTRACT

A soft key includes a main body, a shank casing, and a shank. The main body includes a compartment defined by a pair of wall tracks. The shank casing is mounted in the main body and movable along the wall tracks between a first position in the main body and a second position out of the main body. The shank is extended through a longitudinal hole of the shank casing and the compartment of the main body. The shank includes a first end positioned in the main body and a second end, a plurality of key sections being attached to the second end of the shank in series. Each two adjacent key sections are connected by a pin, thereby allowing relative pivotal movement therebetween. Each key section includes a depression in a side thereof. An outermost key section that is most distal to the shank includes at least one slanted face.

3 Claims, 5 Drawing Sheets

SOFT KEY

BACKGROUND OF THE INVENTION

1. Field of the Invention

The present invention relates to a soft key that is shorter for convenient carriage.

2. Description of the Related Art

Taiwan Utility Model Publication No. 162749 issued on Jul. 1, 1991 and entitled "LOCKSET HAVING A LOCK CORE WITH A ZIGZAG KEYWAY", as illustrated in FIG. 7A of the drawings, discloses a lockset having a lock core 91 with a zigzag keyway 92. As illustrated in FIG. 7B, the key 93 for the zigzag keyway may be bent so as to move along the zigzag keyway. FIGS. 8A through 8C illustrate a typical key 93 that includes a resilient, bendable shank 931 and a plurality of guide blocks 932 that are connected in series. A plurality of teeth 933 are formed on a side of the shank 931 for pushing tumbler pins (not shown) in the lock core 92. The teeth 933 are formed on only one side of the shank 931. Such a key has a larger width. FIG. 9 illustrates another typical key 93' that includes a rigid shank cashing 94' and a telescopic casing 95' through which a plurality of guide blocks 932' are extended. The guide blocks 932' may extend into the zigzag keyway 92 of the lock core 91. Each guide block 932' includes a depression 933' in only one of a pair of relatively larger lateral sides thereof such that the key has a larger width. Use of the key is inconvenient, as the insertion direction of the key is limited. In addition, both the keys shown in FIGS. 8A through 8C and in FIG. 9 have a rigid casing 94, 94' and a telescopic casing 95, 95' such that the keys have a considerable length and are thus inconvenient for carriage. Further, the shank 931 in FIGS. 8A through 8C and the guide blocks 932' in FIG. 9 are exposed outside the telescopic casing 95' and thus tend to hook and cause damage to pockets of clothes receiving the keys.

SUMMARY OF THE INVENTION

It is the primary object of the present invention to provide a soft key that provides a larger operational torque and that is durable and shorter.

A soft key in accordance with the present invention includes a main body, a shank casing, and a shank. The main body includes a compartment defined by a pair of wall tracks. The shank casing is mounted in the main body and movable along the wall tracks between a first position in the main body and a second position out of the main body. The shank is extended through a longitudinal hole of the shank casing and the compartment of the main body. The shank includes a first end positioned in the main body and a second end, a plurality of key sections being attached to the second end of the shank in series. Each two adjacent key sections are connected by a pin, thereby allowing relative pivotal movement therebetween. Each key section includes a depression in a side thereof An outermost key section that is most distal to the shank includes at least one slanted face.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

A preferred embodiment in accordance with the present invention will now be described with reference to the accompanying drawings.

Figure 1:
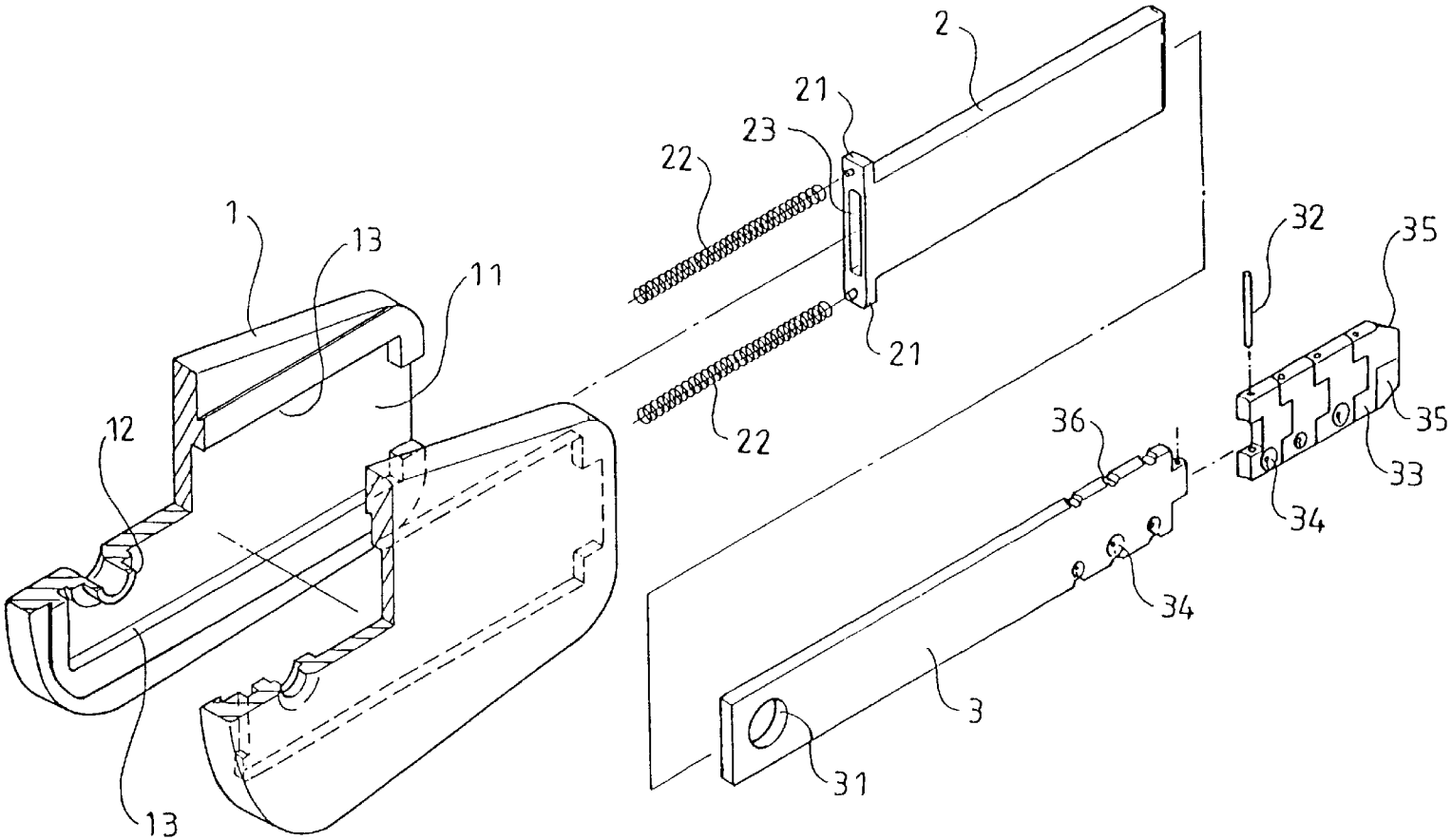
FIG. 1 is an exploded perspective view of a soft key in accordance with the present invention.
Figure 2:
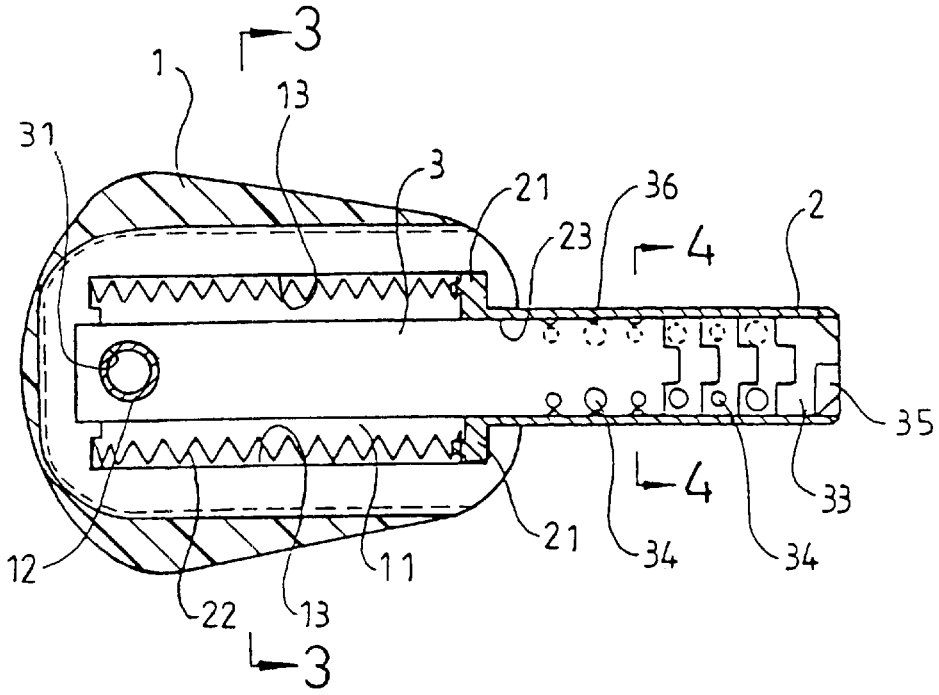
FIG. 2 is a longitudinal sectional view of the soft key in accordance with the present invention.

Referring to FIGS. 1 and 2, a soft key in accordance with the present invention generally includes a main body 1, a shank casing 2, and a shank 3. The main body 1 forms a head of the soft key for grasp. The main body 1 includes a compartment 11 defined by a pair of wall tracks 13 for guiding sliding movement of the shank casing 2. The main body 1 further includes a peg 12 for positioning an end of the shank 3.

The shank casing 2 is made of rigid material, such as metal, rigid plastics, plastic steel, The shank casing 2 is mounted in the compartment 11 of the main body 1 and includes a pair of guides 21 (in the form of protrusions) so as to slide along the wall tracks 13, respectively. Thus, sliding movement of the shank casing 2 is guided and restrained. In order to provide convenient displacement of the shank casing 2, at least one elastic element 22 is provided to an end of the shank casing 2 for biasing the other end of the shank casing 2 out of the main body 1 for operation. In addition, the shank casing 2 includes a longitudinal hole 23 that allows the shank 3 to move therein.

Figure 4:
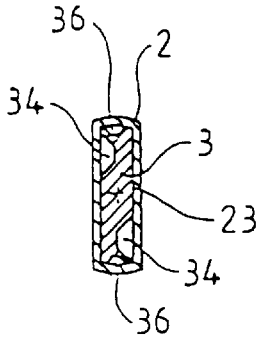
FIG. 4 is a sectional view taken along line 4—4 in FIG. 2.

The shank 3 is made of rigid material, such as metal. An end of the shank 3 (the left one in FIG. 2) has a hole 31 so as to be positioned in the main body 1 by the peg 12 plurality of chain-like key sections 33 are attached to the other end of the shank 3 in series. Each two adjacent key sections 33 are connected by a pin 32, thereby allowing relative pivotal movement therebetween. In addition, each key section 33 includes a depression 34 in each of two relatively larger lateral sides thereof, best shown in FIG. 4. The shank 3 includes a plurality of depressions 34 in a lateral side thereof Further, the outermost key section 33 that is most distal to the shank 3 includes at least one slanted face 35 for guiding tumbler pins 43, 44 (FIG. 6) in the lock core 41 of a lockset 4 into the depressions 34 of the shank 3 and the key sections 33, such that a shear line between the upper tumbler pins 43 and the lower tumbler pins 44 is aligned with that between the lock core 41 and the lockset main body 42 to achieve unlocking operation. If necessary, upper and lower sides of the shank 3 may include notches 36 or teeth to provide more combinations for the tumbler pins, thereby improving safety.

Figure 3:
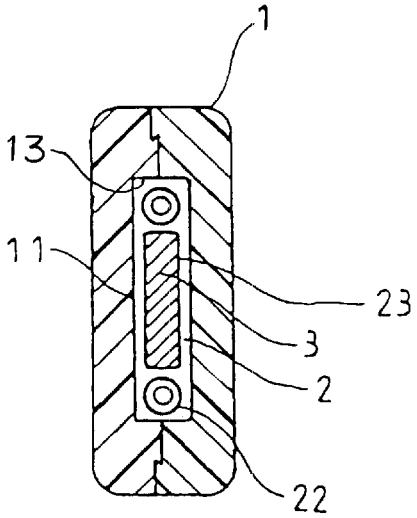
FIG. 3 is a sectional view taken along line 3—3 in FIG. 2.

Referring to FIGS. 2 and 3, the shank 2 is biased outward by the elastic elements 22 such that the other end of the shank casing 2 is moved out of the main body 1. The soft key has a maximum length at this status.

Figure 5:
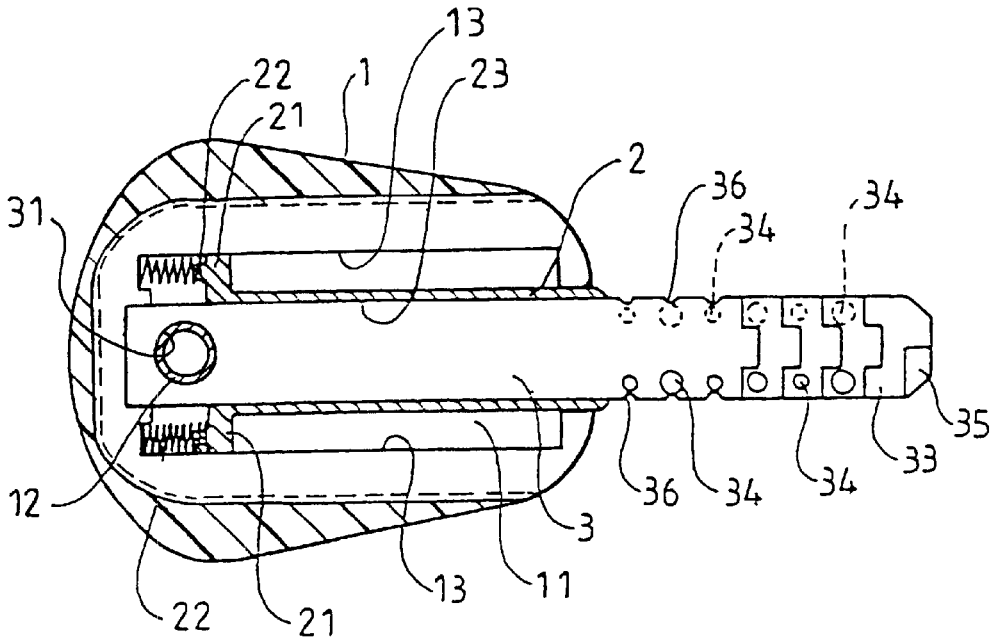
FIG. 5 is a sectional view similar to FIG. 2, wherein a shank casing is retracted into a main body of the soft key.
Figure 6:
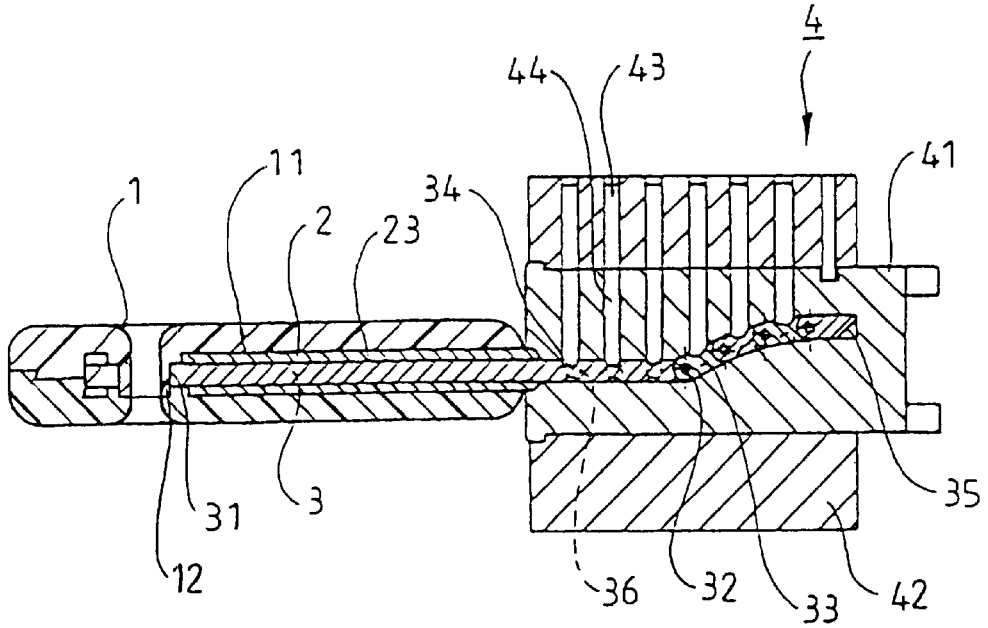
FIG. 6 is a sectional view illustrating insertion of the soft key into a lock core.
Figure 8A:
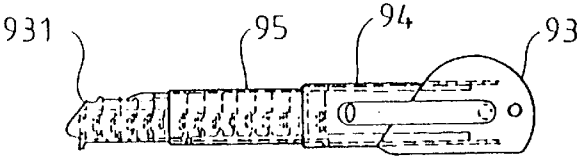
FIG.8A PRIOR ART
FIG. 8A is a side view of a conventional soft key.
Figure 8B:
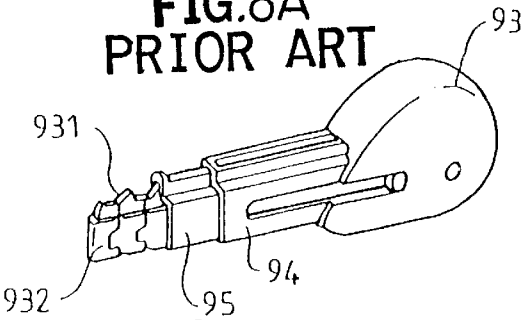
FIG.8B PRIOR ART
FIG. 8B is a perspective view of the conventional soft key in FIG. 8A.
Figure 8C:
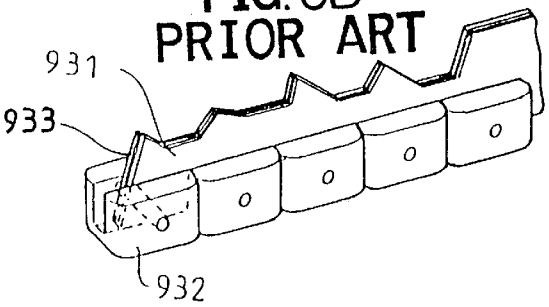
FIG.8C PRIOR ART
FIG. 8C is an enlarged perspective view of an end portion of the soft key in FIG. 8B.
Figure 7A:
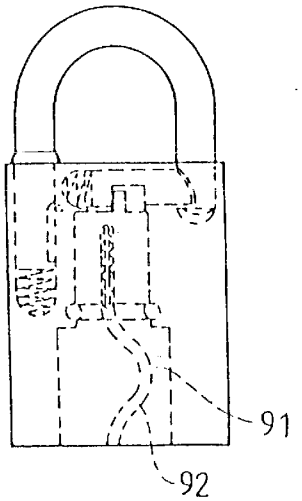
FIG.7A PRIOR ART
FIG. 7A is a schematic view of a lockset having a lock core with a zigzag keyway.
Figure 7B:
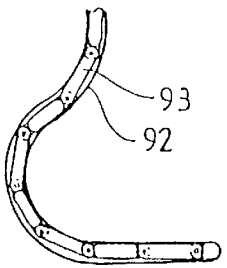
FIG.7B PRIOR ART
FIG. 7B is an enlarged view of the zigzag keyway and a portion of a soft key for the lockset in FIG. 7A.
Figure 9:
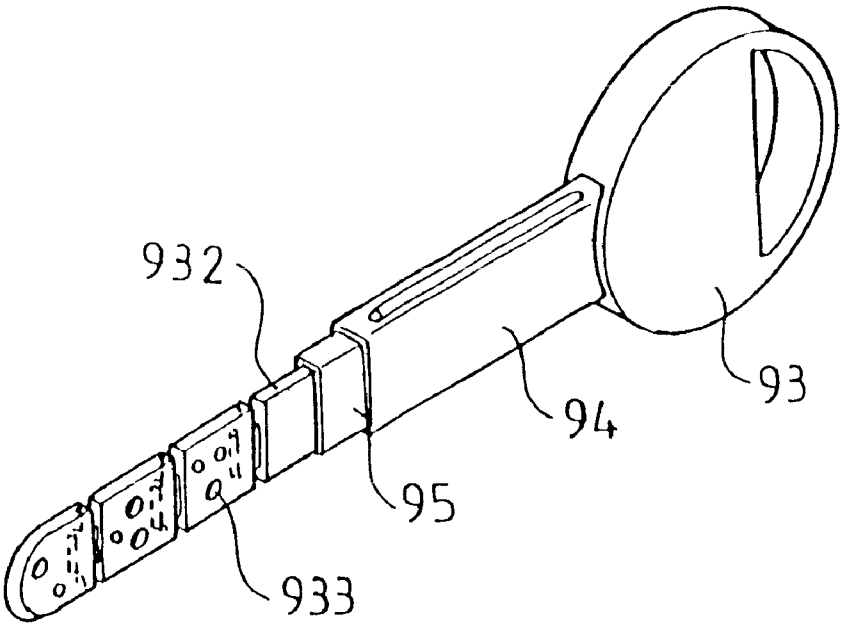
FIG. 9 PRIOR ART
FIG. 9 is a perspective view of another conventional soft key.

Referring to FIGS. 5 and 6, when in use, the shank casing 2 is aligned with a keyway (not labeled) of the lock core 41 of the lockset 4. A force is applied to the main body 1 to insert it into the keyway. The shank casing 2 is retracted into the compartment 11 of the main body 1, and the shank 3 and the key sections 33 are moved into the keyway. As illustrated in FIG. 6, the notches 36 and depressions 34 on the shank 33 and the depressions 34 of the key sections 33 cooperates with the lower tumbler pins 44 such that the shear line between the upper tumbler pins 43 and the lower tumbler pins 44 is aligned with that between the lock core 41 and the lockset main body 42. As a result, the lock core 41 can be turned by the shank 3 to achieve the unlocking operation.

The shank 3 of the soft key is inserted into the lock core such that the torsion for turning the lock core directly acts on the shank 3, instead of the key sections 33. Thus, the longevity of the soft key is lengthened. In addition, the shank 3 may be used to guide the key sections 33. Further, the key sections 33 can be shielded in the shank casing 2 when not in use. As a result, the overall length of the soft key in the non-use status is relatively short when compared with conventional soft keys, which is convenient to carriage. In addition, the shank casing 2 protects the key sections 33. Damage to clothes by the key sections is avoided accordingly.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A soft key comprising:

a main body comprising a compartment defined by a pair of wall tracks;

a shank casing mounted in the main body and movable along the wall tracks between a first position in the main body and a second position out of the main body, the shank casing including a longitudinal hole;

a shank extended through the longitudinal hole of the shank casing and the compartment of the main body, the shank comprising a first end positioned in the main body and a second end, a plurality of key sections being attached to the second end of the shank in series, each two adjacent said key sections being connected by a pin, thereby allowing relative pivotal movement therebetween, each said key section including a depression in a side thereof, an outermost said key section that is most distal to the shank including at least one slanted face; and means mounted between an end of the shank casing and the main body for biasing the other end of the shank casing out of the main body.

2. A soft key comprising:

a main body comprising a compartment defined by a pair of wall tracks;

a shank casing mounted in the main body and movable along the wall tracks between a first position in the main body and a second position out of the main body, the shank casing including a longitudinal hole;

a shank extended through the longitudinal hole of the shank casing and the compartment of the main body, the shank comprising a first end positioned in the main body and a second end, a plurality of key sections being attached to the second end of the shank in series, each two adjacent said key sections being connected by a pin, thereby allowing relative pivotal movement therebetween, each said key section including a depression in a side thereof, an outermost said key section that is most distal to the shank including at least one slanted face; and wherein the shank includes at least one depression that cooperates with an associated lower tumbler pin of a lock core of a lockset to which the soft key is used.

3. A soft key comprising:

a main body comprising a compartment defined by a pair of wall tracks;

a shank casing mounted in the main body and movable along the wall tracks between a first position in the main body and a second position out of the main body, the shank casing including a longitudinal hole;

a shank extended through the longitudinal hole of the shank casing and the compartment of the main body, the shank comprising a first end positioned in the main body and a second end, a plurality of key sections being attached to the second end of the shank in series, each two adjacent said key sections being connected by a pin, thereby allowing relative pivotal movement therebetween, each said key section including a depression in a side thereof, an outermost said key section that is most distal to the shank including at least one slanted face; and wherein the shank further includes at least one notch defined in each of an upper side and lower side thereof, said at least one notch cooperating with an associated lower tumbler pin of a lock core of a lockset to which the soft key is used.

* * * * *